US008261561B2

(12) United States Patent
Rigal et al.

(10) Patent No.: US 8,261,561 B2
(45) Date of Patent: Sep. 11, 2012

(54) FREE-COOLING CAPACITY CONTROL FOR AIR CONDITIONING SYSTEMS

(75) Inventors: Philippe Rigal, Savigneux (FR); Pierre Delpech, Fleurieu sur Saone (FR); Batung Pham, Chassieu (FR)

(73) Assignee: Carrier Corporation, Farmington, CT (US)

( * ) Notice: Subject to any disclaimer, the term of this patent is extended or adjusted under 35 U.S.C. 154(b) by 595 days.

(21) Appl. No.: 12/521,733

(22) PCT Filed: Dec. 28, 2006

(86) PCT No.: PCT/US2006/049447

§ 371 (c)(1),
(2), (4) Date: Jun. 29, 2009

(87) PCT Pub. No.: WO2008/082379

PCT Pub. Date: Jul. 10, 2008

(65) Prior Publication Data

US 2010/0042265 A1 Feb. 18, 2010

(51) Int. Cl.
*F25B 1/00* (2006.01)

(52) U.S. Cl. ..... 62/115; 62/498

(58) Field of Classification Search ..... 62/498, 62/231, 126, 127, 125, 129; 700/300
See application file for complete search history.

(56) References Cited

U.S. PATENT DOCUMENTS 2,244,312 A 6/1941 Newton
5,161,388 A * 11/1992 Fujita et al. ..... 62/175
5,598,717 A * 2/1997 Sakamoto et al. ..... 62/211
5,632,154 A * 5/1997 Sibik et al. ..... 62/99
5,791,155 A * 8/1998 Tulpule ..... 62/211
5,860,286 A * 1/1999 Tulpule ..... 62/129
6,141,981 A 11/2000 Reason et al.
6,293,123 B1 * 9/2001 Iritani et al. ..... 62/409
6,343,482 B1 * 2/2002 Endo et al. ..... 62/324.6
6,405,554 B1 * 6/2002 Kawakatu et al. ..... 62/335
6,530,236 B2 * 3/2003 Crane et al. ..... 62/89
6,637,226 B2 * 10/2003 Watanabe et al. ..... 62/201
6,640,561 B2 11/2003 Roberto
6,826,921 B1 * 12/2004 Uselton ..... 62/176.6
6,845,626 B2 * 1/2005 Matsuoka et al. ..... 62/149
6,970,750 B2 11/2005 Wojsznis et al.

(Continued)

FOREIGN PATENT DOCUMENTS

CA 2298373 A1 8/2001

(Continued)

OTHER PUBLICATIONS

European Search Report for International Application No. PCT/US2006049447, Feb. 8, 2011, 5 pages.

(Continued)

*Primary Examiner* — Mohammad Ali
(74) *Attorney, Agent, or Firm* — Cantor Colburn LLP

(57) ABSTRACT

An air conditioning system having a free-cooling mode. The system includes a refrigeration circuit have a compressor, a pump, an expansion device having a variable opening, and a controller. The controller selectively operates the system in the free-cooling mode by circulating the refrigerant through the refrigeration circuit via the pump. The system includes a free-cooling capacity control sequence resident on the controller. The free-cooling capacity control sequence adjusts the cooling capacity of the system at least by adjusting the variable opening based on the temperature difference between a working fluid temperature and a set point temperature.

16 Claims, 2 Drawing Sheets

U.S. PATENT DOCUMENTS

| | | | | |
|---|---|---|---|---|
| 2001/0037654 | A1* | 11/2001 | Kobayashi et al. | 62/222 |
| 2002/0005268 | A1* | 1/2002 | Noda et al. | 165/42 |
| 2003/0014988 | A1* | 1/2003 | Watanabe et al. | 62/201 |
| 2003/0172665 | A1* | 9/2003 | Matsuoka et al. | 62/149 |
| 2004/0065099 | A1 | 4/2004 | Grabon et al. | |
| 2006/0130501 | A1* | 6/2006 | Singh et al. | 62/183 |
| 2010/0036531 | A1* | 2/2010 | Chessel et al. | 700/275 |
| 2010/0070082 | A1* | 3/2010 | Chessel et al. | 700/275 |

FOREIGN PATENT DOCUMENTS

| | | | |
|---|---|---|---|
| JP | 60057154 | A | 4/1985 |
| JP | 1067568 | A2 | 3/1989 |

OTHER PUBLICATIONS

International Search Report, mailed Oct. 23, 2007 for PCT/US06/49447 filed Dec. 28, 2006.

* cited by examiner

FREE-COOLING CAPACITY CONTROL FOR AIR CONDITIONING SYSTEMS

BACKGROUND OF THE INVENTION

1. Field of the Invention

The present disclosure relates to air conditioning systems. More particularly, the present disclosure relates to methods and systems for controlling air conditioning systems having a free-cooling mode and a cooling mode.

2. Description of Related Art

An air conditioning system operates by expending energy to cool a given volume of air. Typically, air conditioning systems are run in a chiller or cooling mode, which includes circulating a refrigerant through a thermodynamic cycle. During the cycle, heat and work are transferred to the refrigerant. The refrigerant enters a heat exchanger and chills a working fluid such as water, air, or glycol, which in turn can be used to cool a conditioned space. Work is generally transferred to the refrigerant using a compressor.

However, when the temperature of the ambient outside air is low, the outside air may be used to cool the refrigerant without engaging the compressor. When ambient outside air is used by an air conditioning system to cool the refrigerant, the system is referred to as operating in a free-cooling mode. Because running the air conditioning system in a free-cooling mode requires less work input, running the system in free-cooling mode is more efficient than running the system in cooling mode.

Traditionally, air conditioning systems have been run in cooling mode even when the ambient outside air temperature is low. Running in cooling mode under such conditions provides a low efficiency means of conditioning the refrigerant. In contrast, running the air conditioning system under such conditions in a free-cooling mode is more efficient. In the free-cooling mode, one or more ventilated heat exchangers and pumps are activated and the refrigerant circulating throughout the air conditioning system is cooled by outside ambient air without the need for a compressor.

Accordingly, there is a need for methods and systems for controlling the cooling capacity of air conditioning systems when those systems are operating in free-cooling mode.

BRIEF SUMMARY OF THE INVENTION

Air conditioning systems and methods of controlling are provided that, when operating in free-cooling mode, include a free-cooling capacity control sequence that varies an opening of an expansion device based at least upon a temperature difference between working fluid leaving the air conditioning system and a set point.

An air conditioning system having a free-cooling mode is provided. The system includes a refrigeration circuit have a compressor, a pump, an expansion device having a variable opening, and a controller. The controller selectively operates the system in the free-cooling mode by circulating the refrigerant through the refrigeration circuit via the pump. The system includes a free-cooling capacity control sequence resident on the controller. The free-cooling capacity control sequence adjusts the cooling capacity of the system at least by adjusting the variable opening based on the temperature difference between a working fluid temperature and a set point temperature.

A method of controlling an air conditioning system having a free-cooling mode is also provided. The method includes determining a temperature of a conditioned working fluid, increasing the cooling capacity of the system at least by increasing an opening of a refrigerant expansion device when the temperature is above a set point, and decreasing the cooling capacity of the system at least by decreasing an opening of a refrigerant expansion device when the temperature is below a set point.

The above-described and other features and advantages of the present disclosure will be appreciated and understood by those skilled in the art from the following detailed description, drawings, and appended claims.

DETAILED DESCRIPTION OF THE INVENTION

Figure 1:
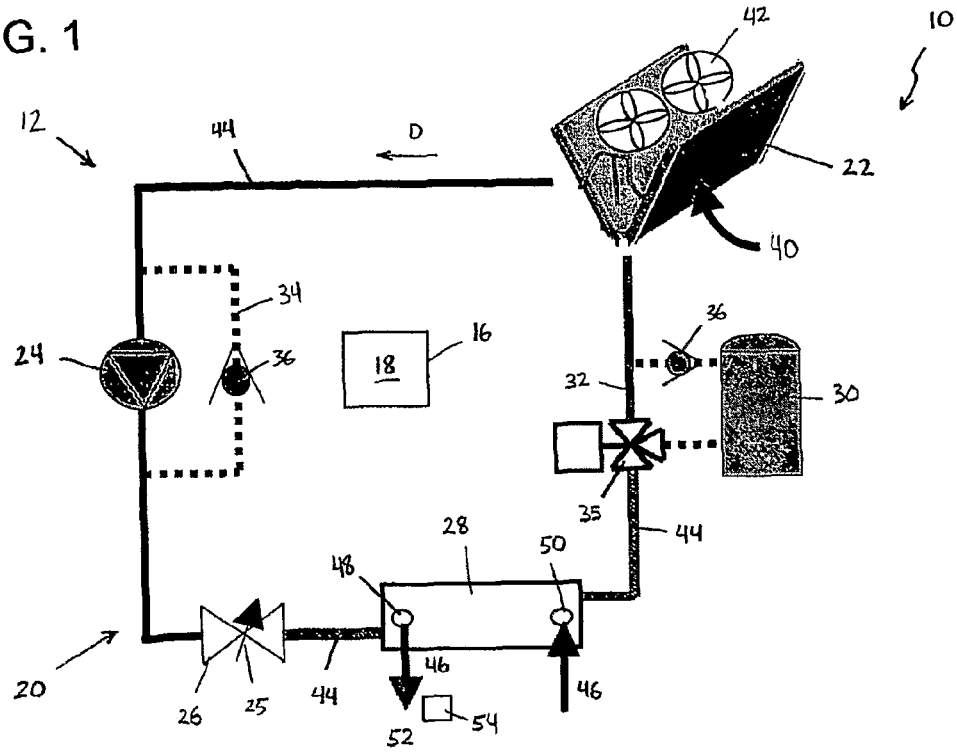
FIG. 1 is an exemplary embodiment of an air conditioning system in free-cooling mode according to the present disclosure.
Figure 2:
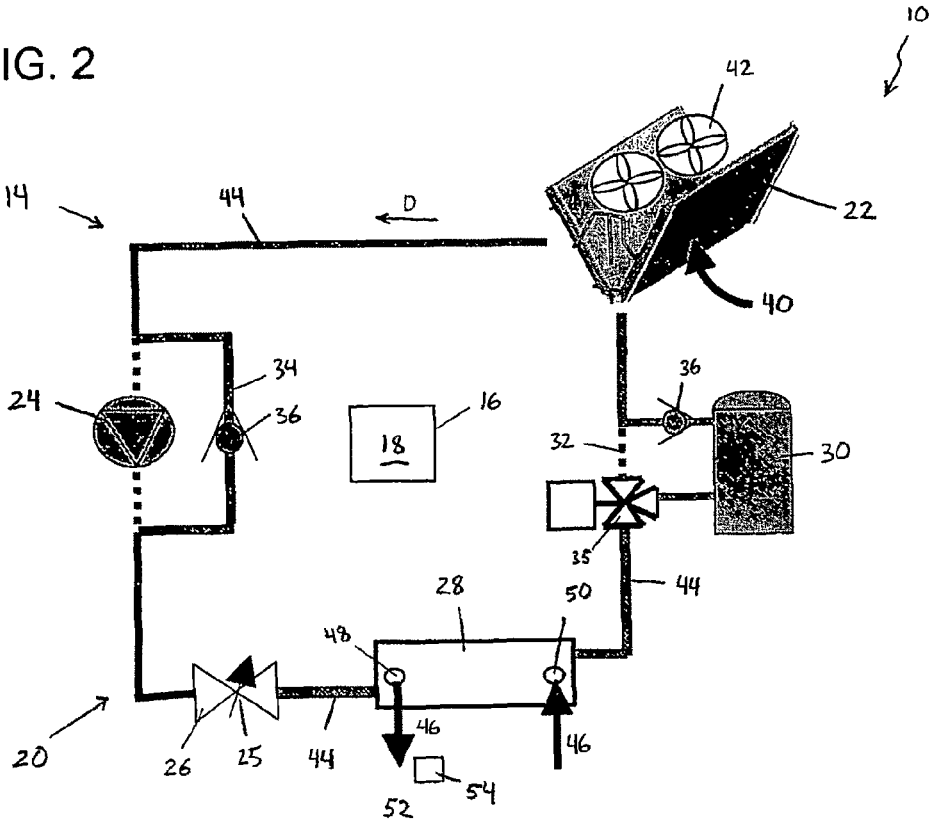
FIG. 2 is an exemplary embodiment of an air conditioning system in cooling mode according to the present disclosure.

Referring now to the drawings and in particular to FIGS. 1 and 2, an exemplary embodiment of an air conditioning system ("system") is shown, generally referred to by reference numeral 10. System 10 is configured to operate in a free-cooling mode 12 (FIG. 1) and a cooling mode 14 (FIG. 2).

System 10 includes a controller 16 for selectively switching between free-cooling and cooling modes 12, 14. Advantageously, controller 16 includes a capacity control sequence ("sequence") 18 thatcmonitors one or more conditions in system 10, when operating in free-cooling mode 12, and adjust the size of an opening of an expansion device to adjust the cooling capacity of system 10. Compared to prior art systems, sequence 18 improves performance of system 10 while operating in free-cooling mode 12 by allowing greater control over the cooling capacity of system 10.

System 10 includes a refrigeration circuit 20 having a condenser 22, a pump 24, an expansion device 26, an evaporator 28, and a compressor 30. Controller 16 is configured to selectively control either pump 24 (when in free-cooling mode 12) or compressor 30 (when in cooling mode 14) to circulate the refrigerant through system 10 in a flow direction (D). Thus, system 10, when in free-cooling mode 12, controls pump 24 to circulate the refrigerant in flow direction D. However, system 10, when in cooling mode 14, controls compressor 30 to compress and circulate the refrigerant in flow direction D. Free-cooling mode 12 uses less energy than cooling mode 14 because free-cooling mode 12 does not require additional work input to operate compressor 30.

System 10 may include any number of refrigeration circuits 20 depending on the cooling requirements for a given application. Advantageously, this allows for greater control of the cooling capacity of system 10.

System 10 includes a compressor by-pass loop 32 and a pump by-pass loop 34. System 10 includes a three-way valve 35 controlled by controller 16 and one or more valves 36, allowing the controller to selectively position valve 35 to selectively open and close compressor by-pass loops 32 as needed. Valves 36 are preferably check valves that only allow flow in one direction within system 10. In one embodiment, valves 36 are mechanical valves without any control. In another embodiment, valves 36 are controlled by controller 16. Valves 36 prevent refrigerant from flowing back into the compressor when by-pass loop 32 is closed, and also prevent refrigerant from flowing back to a suction side of pump 24 when the pump is operating.

In cooling mode 14, controller 16 controls valve 35 so that compressor by-pass loop 32 is closed. In this configuration, pump 24 does not operate, and system 10 allows compressor 30 to compress and circulate the refrigerant in the flow direction D by flowing through pump by-pass loop 34.

In contrast, controller 16, when in free-cooling mode 12, controls three-way valve 35 so that compressor by-pass loop 32 is open. In this configuration, system 10 allows pump 24 to circulate refrigerant in flow direction D by flowing through compressor by-pass loop 32.

Accordingly, system 10 provides heat transfer between a refrigerant 44 and a working fluid 46, in evaporator 28. Heat is transferred from working fluid 46 to refrigerant 44, cooling working fluid 46. Cooled working fluid 46 exits evaporator 28 at an outlet 48, circulates throughout the area to be cooled, and returns to the evaporator through an inlet 50. This process occurs in both free-cooling and cooling modes 12, 14. Refrigerant 44 can be R22, R410A, or any other known refrigerant. Working fluid 46 can be air, water, glycol, or any other working fluid known in the art.

In cooling mode 14, system 10 operates as a standard vapor-compression air conditioning system known in the art where the compression and expansion of the refrigerant via expansion device 26 are used to condition working fluid 46. Expansion device 26 can be any known expansion device such as, but not limited to a controllable expansion device (e.g., a thermal expansion valve). In one preferred embodiment, expansion device 26 is an electronically controllable expansion valve. In another preferred embodiment, expansion device 26 is a two-way valve. In the example where expansion device 26 is a controllable expansion device, the expansion device is preferably controlled by controller 16. Thus, expansion device 26 includes an opening 25 that can be controlled between, for example, a fully open position and a substantially closed position.

In free-cooling mode 12, system 10 takes advantage of the heat removing capacity of outside ambient air 40, which is in heat exchange relationship with condenser 22 via one or more fans 42.

System 10 includes a temperature sensor 54 positioned to measure a temperature 52 of working fluid 46 as the working fluid leaves evaporator 28. Temperature sensor 54 can be any temperature-sensing element known in the art, including, but not limited to, a resistance thermal device, a thermocouple, a thermistor, and others.

System 10 maintains the leaving temperature 52 of working fluid 46 near a set temperature (set point), the set point being stored within controller 16 and being determined by the cooling requirements for a given application under a given set of circumstances. In one preferred embodiment, the set point can be determined automatically by controller 16. In another preferred embodiment, the set point is entered by a user. When the set point is increased or decreased by controller 16, system 10 decreases or increases its cooling capacity so that leaving temperature 52 of working fluid 46 matches the new set point.

In one exemplary embodiment, leaving temperature 52 is determined using a temperature sensor 54. Preferably, controller 16 interfaces with first temperature sensor 54 to determine when the cooling capacity of system 10 should be adjusted based on leaving temperature 52 and the set point.

Each refrigeration circuit 20 may include multiple compressors 30. In cooling mode 14, the cooling capacity of system 10 can be adjusted by increasing the number of compressors 30 that are in service. For example, in a refrigeration circuit having four compressors, one compressor may be utilized when the cooling requirements are low (higher set point), and all four compressors may be used when the cooling requirements are higher (lower set point). However, in free-cooling mode 12, compressors 30 are bypassed using compressor bypass loop 32 and so this mechanism cannot be used to control cooling capacity in system 10.

Advantageously, controller 16 includes sequence 18 that monitors and varies one or more conditions in system 10 to adjust the cooling capacity of the system while in free-cooling mode 12.

In one preferred embodiment, controller 16 is a proportional-integral-derivative (PID) controller. Controller 16 implements sequence 18, which takes the measured value of leaving temperature 52 and compares it with the set point. The difference between these two values is then used to adjust the cooling capacity of system 10 until leaving temperature 52 is approximately equal to the set point. In this manner, sequence 18 continually monitors and adjusts the cooling capacity of system 10.

Figure 3:
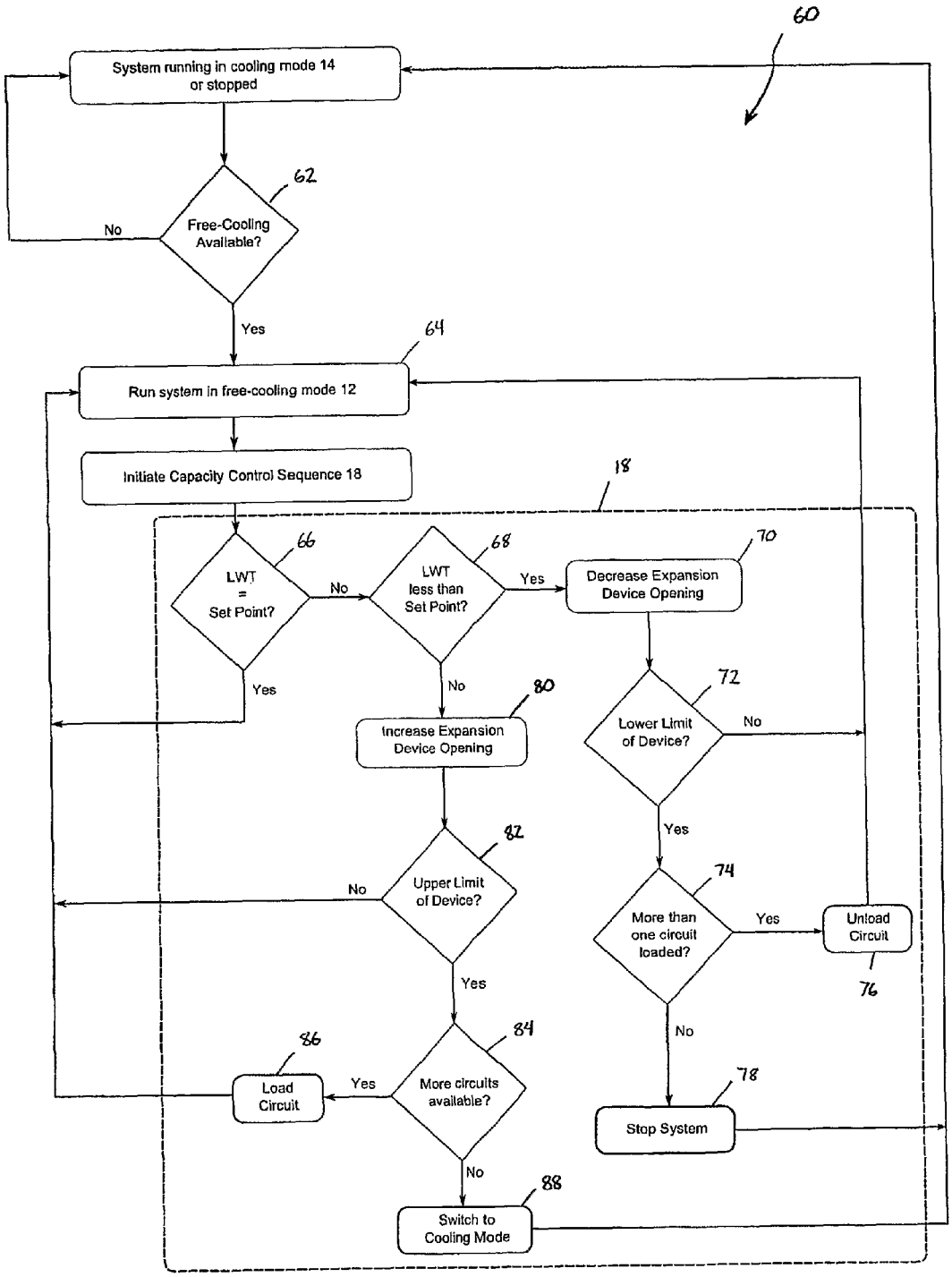
FIG. 3 illustrates an exemplary embodiment of a method for controlling the capacity in free cooling mode of an air conditioning system according to the present disclosure.

FIG. 3 describes in greater detail the operation of sequence 18. Method 60, when system 10 is operating in cooling mode 14, includes a first free-cooling determination step 62. During first free-cooling determination step 62, method 60 determines whether system 10 can operate in free-cooling mode 12. If the temperature difference between leaving temperature 52 and the temperature of outside ambient air 40 is not sufficient to run system 10 in free-cooling mode 12, system 10 will continue to run in cooling mode 14. However, if the necessary conditions for free-cooling are met, method 60 performs a first switching step 64, so that system 10 operates in free-cooling mode 12.

After first switching step 64, controller 16 initiates sequence 18. Sequence 18 includes a first temperature comparison step 66. In first temperature comparison step 66, method 60 determines whether leaving temperature 52, shown as a leaving water temperature or LWT, is approximately equal to the set point.

If leaving temperature 52 is approximately equal to the set point at first temperature comparison step 66, sequence 18 determines that the cooling capacity of system 10 is sufficient and no adjustment is necessary. Thus, controller 16, via sequence 18, continually monitors system 10 to ensure that leaving temperature 52 remains approximately equal to the set point. If sequence 18 determines that leaving temperature 52 is not approximately equal to the set point at first temperature comparison step 66, method 60 performs a second temperature comparison step 68.

At second temperature comparison step 68, when method 60 determines that leaving temperature 52 is less than the set point, method 60 performs a first expansion device adjustment step 70, wherein controller 16 decreases the size of opening 25 of expansion device 26. By decreasing the size of opening 25, the flow of refrigerant 44 decreases, and thus the cooling capacity of system 10 also decreases. Controller 16 may vary the size of opening 25 in any known manner. For example, the size of opening 25 may be adjusted linearly with respect to the difference between leaving temperature 52 and the set point. Alternatively, the size of opening 25 may be adjusted non-linearly with respect to the difference between leaving temperature 52 and the set point. Expansion device 26 has an upper limit, when the expansion device opening 25 is fully opened, and a lower limit, when the expansion device is substantially closed. In some embodiments, controller 16 is configured to continually vary the size of opening 25 to continually adjust the cooling capacity of system 10. In other embodiments, controller 16 is configured to periodically vary the size of opening 25 to periodically adjust the cooling capacity of system 10.

After first expansion device adjustment step 70, method 60 performs a device lower limit checking step 72. Device lower limit checking step 72 determines whether the lower limit of expansion device 26 has been reached. The lower limit of expansion device 26 is reached when the size of opening 25 can no longer be decreased while still maintaining system 10 in operable condition in free-cooling mode 12. If the lower limit of expansion device 26 has not been reached, system 10 continues to operate in free-cooling mode 12 and sequence 18 continues to monitor leaving temperature 52 and to adjust opening 25 to ensure that system 10 has sufficient cooling capacity.

In embodiments where system 10 includes more than one refrigeration circuit 20, and if, after performing adjustment step 70, the lower limit of expansion device 26 has been reached, method 60 can perform a first circuit checking step 74. In first circuit checking step 74, method 60 determines if there are any more refrigerant circuits 20 available in system 10. System 10 may include multiple refrigeration circuits 20. However, depending on the cooling requirements of the space being cooled, system 10 may not utilize all of refrigeration circuits 20. Thus, when the cooling requirements do not require all of the refrigeration circuits 20, one or more refrigeration circuits 20 may be turned off and disconnected or unloaded from system 10. Conversely, if the cooling requirements increase, one or more refrigeration circuits 20 may be connected or loaded to system 10.

If method 60 determines at first circuit checking step 74 that there is more than one circuit in operation, method 60 then performs an unloading step 76 wherein one of the refrigeration circuits 20 is unloaded from system 10, thus reducing the cooling capacity of system 10. After performing unloading step 76, system 10 continues to operate in free-cooling mode 12 and controller 16 continues to monitor and adjust the size of opening 25 of expansion device 26 in any remaining loaded refrigeration circuit 20 in system 10.

If the cooling capacity of system 10 is too high, and method 60 cannot sufficiently reduce the cooling capacity by adjusting the expansion valve and unloading refrigeration circuits, system 10 is stopped at a stopping step 78. System 10 is now ready to restart in free cooling mode 12 if more cooling capacity is needed and if free-cooling determination step 62 determines that system 10 can operate in free-cooling mode 12.

Referring again to second temperature comparison step 68, when method 60 determines that leaving temperature 52 is greater than the set point, method 60 performs a second expansion device adjustment step 80, wherein controller 16 increases the size of opening 25 of expansion device 26. Increasing the size of opening 25 increases the flow of refrigerant 44, and thus increases the cooling capacity of system 10. After second expansion device adjustment step 80, method 60 performs a device upper limit checking step 82. Device upper limit checking step 82 determines whether the upper limit of expansion device 26 has been reached, or in other words, whether opening 25 of expansion device 26 is fully opened.

If method 60 determines that expansion device 26 is less than fully opened at device upper limit checking step 82, system 10 continues to run in free-cooling mode and controller 16 continues to monitor and adjust the size of opening 25 to maintain sufficient cooling capacity in the system.

In embodiments where system 10 includes more than one refrigeration circuit 20, and if method 60 determines that expansion device 26 is fully opened, a second circuit checking step 84 can be performed to determine whether there are more refrigeration circuits 20 that can be loaded onto system 10 to provide greater cooling capacity. If method 60 determines that there are one or more refrigeration circuits 20 available, an additional refrigeration circuit 20 is loaded onto system 10 at loading step 86.

After loading step 86, system 10 continues to run in free-cooling mode 12 and controller 16 continues to monitor and adjust the size of opening 25 to maintain sufficient cooling capacity in the system. Conversely, if method 60 determines that system 10 does not have additional refrigeration circuits 20 available, second switching step 88 is performed, switching system 10 out of free-cooling mode 12 and into cooling mode 14.

Thus, method 60, due to the initiation of sequence 18, controls system 10 based at least on the difference between leaving temperature 52 and a set point temperature to selectively control flow through expansion device 26 to maintain a desired level of cooling capacity. Method 60 varies expansion device 26 anywhere between a fully open position and a substantially closed position, and any sub-ranges therebetween. When cooling capacity of system 10 is below the desired level, that is when leaving temperature 52 is greater than the set point, controller 16 increases the size of opening 25 of expansion device 26 and/or loads additional refrigeration circuits 20 onto system 10. When cooling capacity of system 10 is above the desired level, that is when leaving temperature 52 is less than the set point, controller 16 decreases the size of opening 25 of expansion device 26 and/or unloads the additional refrigeration circuit 20 from system 10. Controller 16 then continues to monitor leaving temperature 52 and adjusts the size of opening 25 and/or the number of refrigeration circuits that are loaded onto system 10.

If the desired cooling capacity cannot be reached in free-cooling mode 12 by adjusting the expansion valve and adding more refrigeration circuits 20 to system 10, method 60 switches system 10 into cooling mode 14.

It should be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An air conditioning system having a free-cooling mode, the system comprising:

a refrigeration circuit having a pump, a compressor, a condenser, an evaporator and an expansion device with a variable opening;

a controller for selectively operating said refrigeration circuit in the free-cooling mode by circulating a refrigerant through said refrigeration circuit via said pump and bypassing said compressor; and a free-cooling capacity control sequence resident on said controller, said free-cooling capacity control sequence adjusting a cooling capacity of said refrigeration circuit at least by adjusting said variable opening based on a temperature difference between a working fluid temperature exiting said evaporator and a set point temperature.

2. The system of claim 1, wherein said free-cooling capacity control sequence is configured to reduce a size of said variable opening when said working fluid temperature is less than said set point temperature.

3. The system of claim 1, wherein said free-cooling capacity control sequence is configured to switch said refrigeration circuit out of free-cooling mode when said variable opening reaches a predetermined limit.

4. The system of claim 2, wherein said refrigeration circuit comprises multiple refrigeration circuits; wherein said free-cooling capacity control sequence is configured to load and unload said multiple refrigeration circuits to said refrigeration circuit.

5. The system of claim 1, wherein said free-cooling capacity control sequence increases a size of said variable opening when said working fluid temperature is greater than said set point temperature.

6. The system of claim 5, wherein said refrigeration circuit comprises multiple refrigeration circuits; wherein said free-cooling capacity control sequence is configured to load and unload said multiple refrigeration circuits to said refrigeration circuit.

7. The system of claim 1, wherein said free-cooling capacity control sequence varies said variable opening linearly with respect to said temperature difference.

8. The system of claim 1, wherein said free-cooling capacity control sequence varies said variable opening non-linearly with respect to said temperature difference.

9. The system of claim 1, wherein said controller is a proportional-integral-derivative controller.

10. The system of claim 1, further comprising: a temperature sensor measuring said working fluid temperature, wherein said controller interfaces with said temperature sensor and calculates said temperature difference.

11. A method of controlling an air conditioning system having a refrigeration circuit and a free-cooling mode, the method comprising:

operating the air conditioning system in the free cooling mode by circulating refrigerant through said refrigeration circuit via a pump and bypassing a compressor;

determining a temperature of a conditioned working fluid;

increasing an opening of a refrigerant expansion device when said temperature is above a set point; and decreasing said opening of said refrigerant expansion device when said temperature is below a set point.

12. The method of claim 11, wherein the refrigeration circuit comprises a plurality of refrigeration circuits; the method further comprising loading a second refrigeration circuit to said refrigeration circuit.

13. The method of claim 12, further comprising:

determining whether an upper limit of said opening of said refrigerant expansion device has been reached;

loading said second refrigeration circuit when said upper limit has been reached.

14. The method of claim 11, wherein the refrigeration circuit comprises a plurality of refrigeration circuits; the method further comprising unloading a second refrigeration circuit from said refrigeration circuit.

15. The method of claim 14, further comprising:

determining whether a lower limit of said opening of said refrigerant expansion device has been reached;

unloading said second refrigeration circuit when said lower limit has been reached.

16. The method of claim 11, further comprising:

determining whether a lower limit of said opening of said refrigerant expansion device has been reached;

unloading said refrigeration circuit and stopping said system when said lower limit has been reached.

* * * * *